United States Patent [19]

Sifferlen

[11] 4,007,062

[45] Feb. 8, 1977

[54] REINFORCED COMPOSITE ALLOYS, PROCESS AND APPARATUS FOR THE PRODUCTION THEREOF

[75] Inventor: Raymond Henri Sifferlen, Veurey-Voroize, France

[73] Assignee: Societe Industrielle de Combustible Nucleaire, Annecy, France

[22] Filed: Sept. 27, 1974

[21] Appl. No.: 510,000

Related U.S. Application Data

[62] Division of Ser. No. 368,434, June 8, 1973, Pat. No. 3,858,640.

[30] Foreign Application Priority Data

June 9, 1972 France ..... 72.20864

[52] U.S. Cl. ..... 148/2; 75/135; 148/11.5 F; 148/11.5 A; 148/32

[51] Int. Cl.[2] ..... C22F 1/04; C22C 32/00

[58] Field of Search ..... 175/135, 138; 148/2, 148/3, 11.5, 32

[56] References Cited

UNITED STATES PATENTS

| | | | |
|---|---|---|---|
| 3,366,515 | 1/1968 | Fraser et al. | 148/11.5 P |
| 3,399,086 | 8/1968 | Das et al. | 148/32 |
| 3,476,614 | 11/1969 | Jehenson et al. | 148/11.5 P |
| 3,728,108 | 4/1973 | Sifferlen et al. | 75/138 |
| 3,884,676 | 5/1975 | Nadkarni et al. | 148/11.5 P |

*Primary Examiner*—C. Lovell
*Attorney, Agent, or Firm*—Sughrue, Rothwell, Mion, Zinn & Macpeak

[57] ABSTRACT

This invention relates to improved process and apparatus for producing reinforced composite light alloys. The improved apparatus comprises means for feeding a fluidized mixture of particulate additions, carried by a neutral gas, to a crucible in which a basic metal consisting preferably of nearly pure aluminium ingots is molten. Means are provided for stirring the contents of crucible during the feeding of said mixture thereto, in order to prevent the sedimentation or decantation of the dispersion formed therein. Means are further provided for transferring the mixture of basic metal and additions into another receptacle in which the desorption and degasing of said mixture take place.

5 Claims, 4 Drawing Figures

REINFORCED COMPOSITE ALLOYS, PROCESS AND APPARATUS FOR THE PRODUCTION THEREOF

This is a division of application Ser. No. 368,434, filed June 8, 1973, now U.S. Pat. No. 3,858,640.

BACKGROUND OF THE INVENTION

The present invention relates to reinforced composite alloys, and also to a process for the formation of composite alloys, reinforced by dispersed particles. It is also concerned with an apparatus for carrying this process into effect.

SUMMARY OF THE INVENTION

A first object of this invention is a reinforced composite alloy without residual porosity, having improved properties and particularly a good ductility, consisting of a matrix of very pure aluminium having dispersed therein 3 to 20% by weight of an addition in grain form, said addition being insoluble in aluminium both in the solid and liquid states, and said addition grains being dispersed homogeneously throughout the aluminium matrix to which they are bonded individually.

Another object of this invention is a process for preparing a reinforced composite alloy consisting of fine particulate additions incorporated in an aluminium matrix, said process comprising the following steps:

a. forming a dispersion of grains of a refractory material using a fluidized suspension in a stream of preheated gas, which is neutral with respect to the addition grains and to the aluminium;

b. desorbing moisture, oxygen and nitrogen from said grains to superficially activate said grains;

c. introducing said dispersion into the molten aluminium with energetic stirring, at a temperature selected in the range from 850° to 1,300° C; and d. degasing the homogeneous composite product.

Still another object of this invention is a process for preparing a reinforced composite alloy consisting of fine particulate additions in an aluminium matrix, said process comprising the following steps:

a. forming a dispersion of grains of a refractory material using a fluidized suspension in a stream of preheated gas, which is neutral with respect to the addition grains and to the aluminium;

b. desorbing moisture, oxygen and nitrogen from said grains to superficially activate said grains;

c. introducing said dispersion into the molten aluminium with energetic stirring, at a temperature selected in the range from 850° to 1,300° C;

d. degasing the homogeneous composite product;

e. casting the composite product;

f. subjecting the solidified composite product to at least one hot-rolling step; and g. subjecting the rolled composite product to at least one annealing step.

A still further object of this invention is an apparatus for preparing a reinforced composite alloy, which comprises a crucible, means for supplying liquid basic metal to said crucible at a constant temperature and at a substantially constant level, means for causing rapid circulation of a gas, means for introducing particulate additions into said gas, means for imparting mechanical vibrations to said introducing means, means for ensuring the rapid displacement of said additions and said gas, means for simultaneously stirring said metal and introducing said additions into said metal during stirring, said last-named means being connected to said means for rapid displacement of said additions and said gas, means for stirring the dispersion thus obtained and preventing its sedimentation or decantation, and means for transferring the stirred mixture of basic metal and additions to another receptacle, said last-named means desorbing and degasing said mixture.

BRIEF DESCRIPTION OF THE ACCOMPANYING DRAWINGS

Various embodiments of the apparatus for forming the composite alloys according to the invention are hereinafter described by reference to the accompanying drawings in which.

DESCRIPTION OF THE PREFERRED EMBODIMENT

Figure 1:
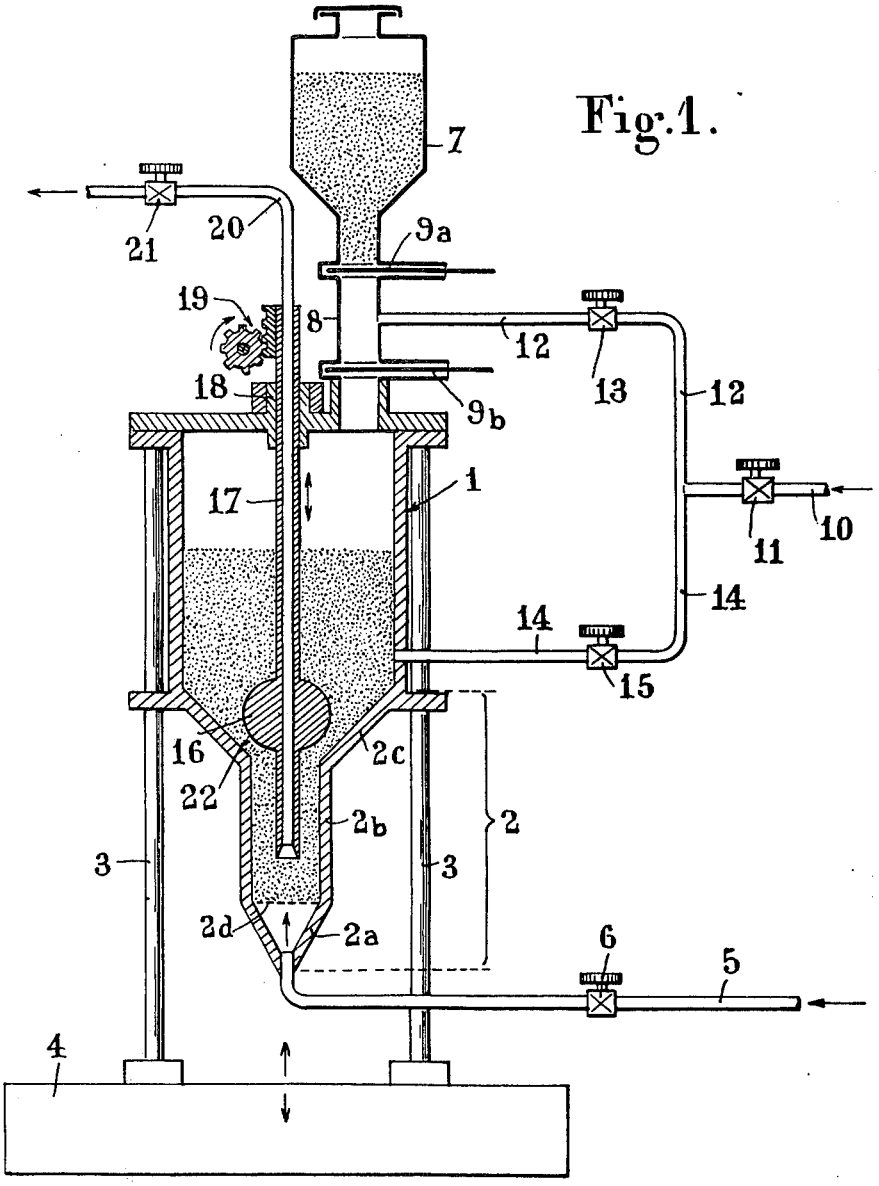
FIGS. 1 and 2 illustrate diagrammatically in fragmentary sections two embodiments of means for introducing the additions into the gas.

The apparatus illustrated in FIG. 1 comprises a container or vessel 1 having a funnel-shaped bottom 2; this container 1 is supported by a vibrating table 4 through vertical columns 3. A conduit 5 provided with a control valve 6 is adapted to supply neutral gas such as air or argon to the lower portion 2*a* of the funnel-shaped bottom 2 of container 1 through a perforated plate or grid 2*d*. At its upper portion the container 1 comprises means for supplying the particulate additions thereto; in the specific form of embodiment contemplated these means comprise a hopper 7 connected to the top of container 1 via a vertical duct 8 in which two sliding-plate shutter valves 9*a*, 9*b* forming a lock chamber between them are mounted. A conduit 10 provided with a control valve 11 is provided for directing neutral gas, such as air or argon, on the one hand, into the lock chamber formed between said shutter valves 9*a* and 9*b* via a branch line 12, comprising a control valve 13, and, on the other hand, into the container 1, at mid-height thereof, through another branch line 14 equipped with a control valve 15. A valve member 16 is supported by a vertical rod 17 within the container 1, above said tapered portion 2*c* of its funnel-shaped bottom 2; said rod 17 extends through the top wall of the container provided to this end with a suitable rod packing 18 in which it is slidably fitted, the outer end of said rod being drivingly connected to a mechanism 19 adapted to produce the vertical movement of said rod for adjusting the position of said valve member 16 in relation to said tapered portion 2*c* of the bottom of container 1. A pipe line 20 equipped with a valve 21 extends coaxially through said rod 17 and valve member 16 so as to open under the latter into the straight lower portion 2*b* of the funnel-shaped bottom 2 of container 1.

The vibrating table 4 is adapted to impart to the above-described assembly vertical vibrations of an amplitude of, say 1 to 3 mm, at a frequency in the range of 25 to 50 Hz. The conduits 5 and 10 may be connected to a common source of neutral gas, such as air. Automatic means known per se and therefore not described in detail herein may be provided for controlling the shutter valves 9*a*, 9*b*, valves 6, 11, 13, 15, 21, and also the mechanism 19, for example as a function of a predetermined program.

The apparatus illustrated in FIG. 1 operates as follows: valve 9*a* is opened first, thus filling the lock chamber formed in the vertical duct 8 between this valve 9*a* and the underlying valve 9*b;* then, valves 11 and 13 are opened together with valve 9*b*, and the neutral gas, which may possibly be fed under a more or less high pressure, facilitates the fall of the particulate additions contained in said lock chamber into the container 1. When the valve member 16 engages the tapered portion 2*c* of the bottom 2 of container 1, the particulate additions accumulate in the upper portion of said container 1, and the latter is filled up to a sufficient level, as shown in FIG. 1. The position of valve member 16 is then adjusted in relation to the tapered valve 2*c* of said bottom 2, so that a flow channel or passage 22 of suitable width is formed therebetween, and the valves 15, 6 and 21 are eventually opened; thus, the neutral gas entering the intermediate portion of container 1 via branch line 14 tends to facilitate the flow of particulate additions through said annular passage 22 towards the straight section 2*b* of bottom 2 of container 1, with an output depending particularly on the width of said annular passage 22, and therefore on the position in which said valve member 16 was adjusted in relation to the tapered wall 2*c;* the particulate additions received in said straight section 2*b* are stopped therein by the perforated grid 2*d* and picked up therefrom by the stream of neutral gas under pressure fed through conduit 5 to the lower portion 2*a* of said bottom 2, and the thus formed fluidized bed rises in the lower portion of pipe line 20 and is directed thereby into the crucible (this pipe line 20 corresponding therefore to the lines 29 illustrated in FIGS. 2, 3, 4 and 5 of U.S. Pat. No. 3,728,108, assigned to the assignee of the present application. The fluidization of the particulate additions by the neutral gas is promoted on the one hand by the vibration imparted by the table 4 to the container 1 and to the various members supported thereby, and on the other hand by the action of the compressed neutral gas fed through said branch lines 12 and 14. In the specific arrangement illustrated in FIG. 1, the control valve 6 of conduit 5 may be kept constantly open during the operation of the apparatus, so as to deliver a constant flow of neutral gas into the lower portion 2*a* of the bottom 2 of container 1 of which the intermediate portion is then recharged periodically via the lock chamber formed in duct 8, as already explained hereinabove. The action exerted by the vibrating table 4 is particularly advantageous in the case of pulverulent additions, notably very finely powdered products having a granulometry of less than one micron.

Figure 2:
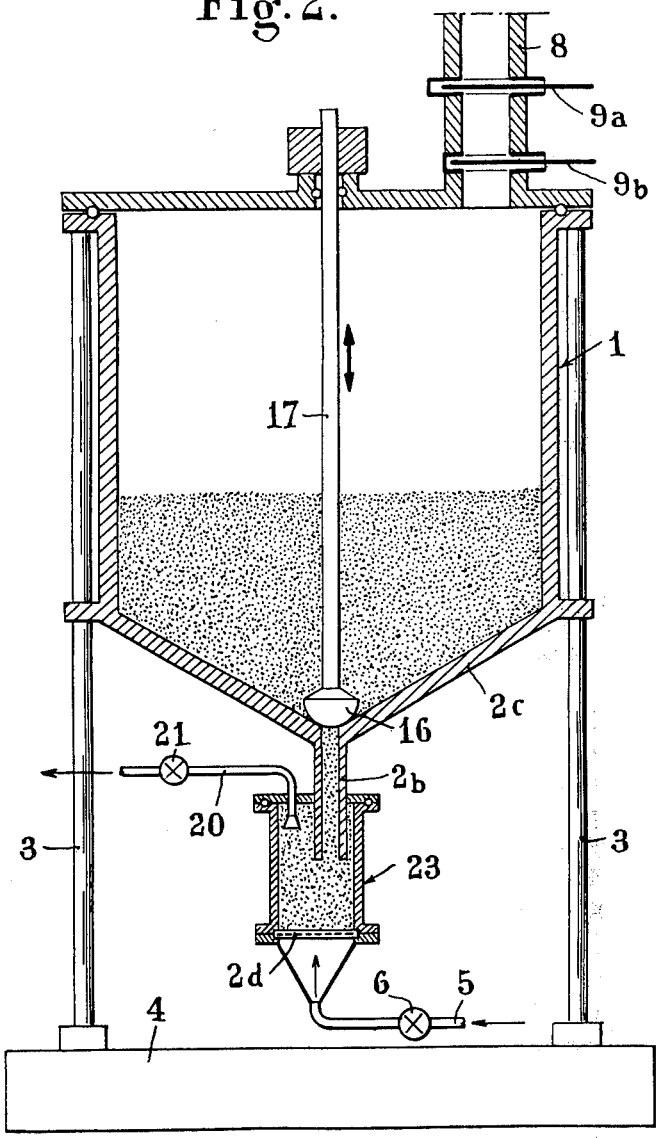

In FIG. 2, the same reference numerals designate homologue elements of FIG. 1. Thus, the apparatus illustrated comprises a hopper 1 provided with a funnel-shaped bottom having a tapered portion 2*c* and a straight section 2*b* constituting a lower discharge pipe for the hopper 1; this discharge pipe 2*b* projects somewhat into the upper portion of a chamber 23 separate from said hopper 1, and the bottom of this chamber is supplied with neutral gas such as air or argon through a conduit 5 provided with a control valve 6 and opening into this chamber 23 beneath a perforated plate or grid 2*d;* a pipe line 20 provided with a control valve 21 is connected to the upper portion of chamber 23 for discharging the fluidized bed consisting of said additions and said gas. The hopper 1 is supported by a vibrating table 4 by means of columns 3; its upper portion is connected to a vertical duct 8 leading from a loading hopper (not shown); this duct 8 is provided with a pair of parallel spaced sliding-plate shutter valves 9*a*, 9*b* forming therebetween a lock chamber; the reference numeral 16 designates a valve member carried by a rod 17 slidably mounted for vertical movement and constituting an efficient means for controlling the input cross-sectional passage area between the lower or discharge section 2*b* of hopper 1 and said valve member 16.

The hopper 1 may be filled with the assistance of the lock chamber formed between said valves 9*a* and 9*b* in duct 8, as already explained hereinabove with reference to FIG. 1; when a sufficient level is attained by the particulate additions in hopper 1, as shown for example in FIG. 2, the passage leading from the hopper 1 to the discharge pipe 2*b* is cleared by moving the valve member 16 away from the tapered bottom 2*c*, i.e. by pulling the sliding rod 17 upwards, in order to fill up completely the independent chamber 23; then both valves 6 and 21 are opened in order to fluidize the particulate additions filling said chamber 23 by means of the neutral gas fed through duct 5, and discharge the fluidized bed thus formed through the discharge line 20. The filling of the aforesaid bottom chamber 23 is also facilitated by the vibration imparted by the table 4 to this chamber. This apparatus may operate continuously, the valves 6 and 21 remaining constantly open, and the chamber 23 can be filled again by lifting the valve member 16 when the amount of particulate additions contained in this chamber 23 tends to become insufficient.

Figure 3:
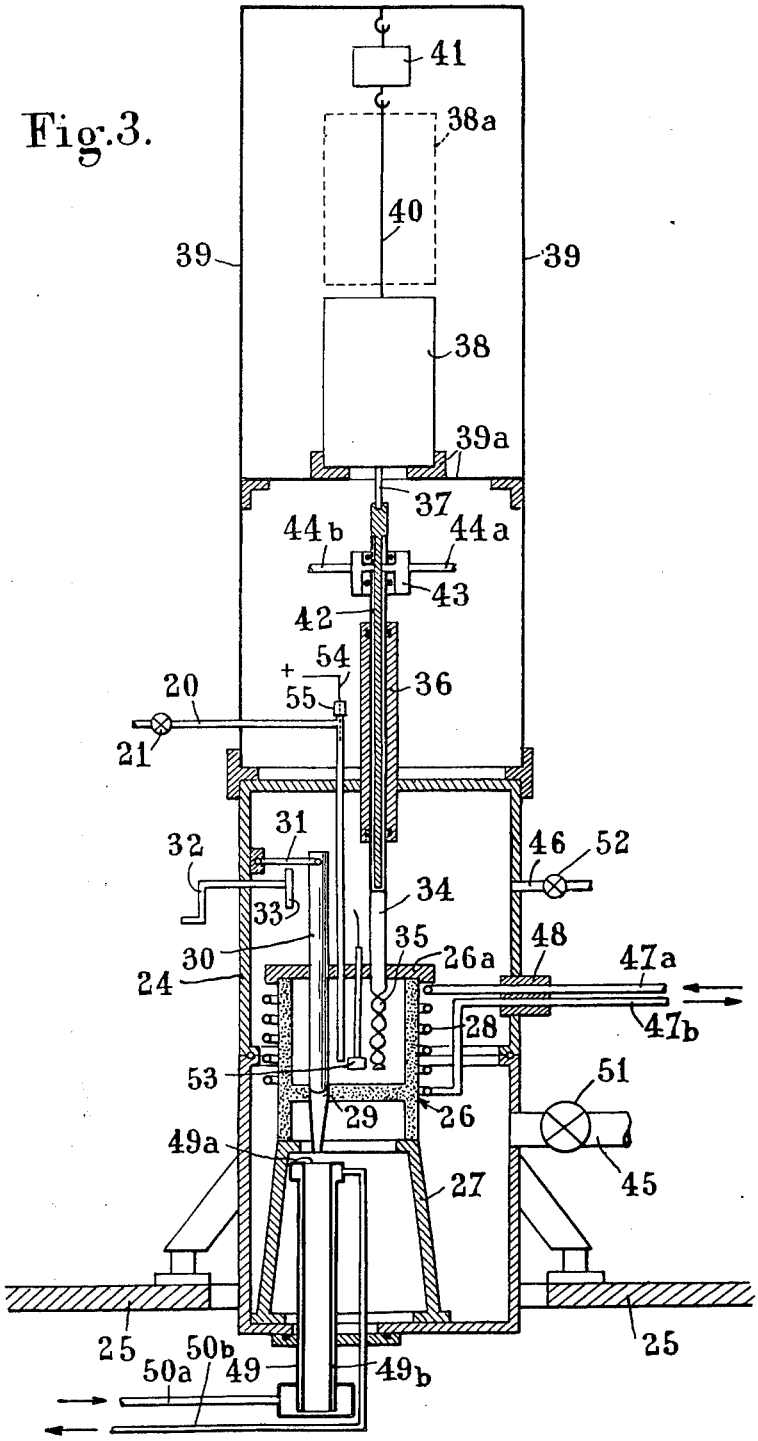
FIGS. 3 and 4 illustrate diagrammatically in fragmentary section two embodiments of means for introducing the stream of additions and gas into the molten metal contained in a crucible, for stirring the mixture in said crucible, and for casting the same from the crucible into at least one ingot mould.

FIG. 3 illustrates a chamber 24 closed in a fluid-tight manner and supported for example by a platform 25; a crucible 26 is supported by a stand 27 laid on the bottom or floor of chamber 24. According to this invention, the walls of crucible 26 consist of insulating material or of conducting material such as graphite. In the form of the embodiment illustrated in FIG. 3 the side wall of crucible 26 is surrounded externally by an induction heating coil 28, and its bottom comprises a runner 29 normally plugged by a stopper-rod 30 extending through the upper detachable lid or cover 26*a* of crucible 26; in the exemplary form of embodiment illustrated, the stopper-rod 30 is supported at its upper end, above the cover 26*a* of crucible 26, by a pivotally mounted arm 31 carried by one wall of chamber 24, and remote control means are provided for lifting the stopper-rod 30 and thus opening the runner 29; in the example illustrated these remote control means are shown diagrammatically as consisting of a crank 32 extending through the wall of chamber 24 and adapted rotatably to drive a cam 33 for lifting the pivoted arm 31. A pipe line 20 extends through the wall of chamber 24 and also through the cover 26*a* of crucible 26 for feeding the fluidized addition bed into this crucible. A vertical shaft 34 extends through the upper wall or roof of chamber 24 and through the cover 26*a* of crucible 26, and carries at its lower end, i.e. within the crucible 26, a helical stirring member in the form of a worm or screw. The upper portion of shaft 34 extending through a sealed bearing 36 carried by the top wall of chamber 24 is coupled to the lower end of the vertical aligned shaft 37 of an electric motor, for example a d.c. motor, 38, suspended in turn from a gantry 39 supported by said chamber 24, by means of a cable 40 and a pulley-block 41; in the normal operative position the motor 38 is supported by a platform 38*a* also carried by said gantry 39 and the stirring member 35 lies inside the crucible 26; on the other hand, it is possible, by actuating said pulley-block 41, to lift the assembly comprising said motor 38, shaft 34 and stirring member 35 until said motor is in its uppermost position 38*a* shown in dash lines, in which said stirring member 35 lies outside and above the crucible 26. In the form of embodiment illustrated an annular cooling chamber 42 is formed in the outer periphery of the vertical shaft 34, and supplied with cooling fluid such as water via a rolling-contact bearing 43, provided with suitable sealing means, and a pair of conduits 44*a* and 44*b*. The lateral wall of chamber 24 also receives therethrough a conduit 45 connected to a suitable source of vacuum (not shown) such as a vacuum pump device, and another conduit 46 connected to a source of neutral gas, such as argon, under suitable pressure; other ducts 47*a* and 47*b* extend through the side wall of chamber 24 and permit of supplying both high-frequency current and cooling water to the coil 28 of crucible 26 by means of suitable high-frequency seals 48. An ingot mould 49 is supported beneath the chamber 24 and platform 25 (through adequate means, not shown) so that its upper open portion 49*a* lies just beneath the runner 29 of the bottom of crucible 26; in the form of embodiment illustrated the wall of this ingot mould comprises a water jacket 49*b* in which suitable conduits 50*a* and 50*b* produce a circulation of water or other cooling fluid.

The apparatus illustrated in FIG. 3 operates as follows: with the stopper-rod 30 plugging the runner 29 of crucible 26 and the stirring member 35 extracted from this crucible, the latter is filled with ingots of solid basic metal which are melted by energizing the coil 28; then, by actuating the pulley-block 41, the stirring member 35 is lowered inside the crucible 26 and the motor 38 is also energized so as to drive said stirring member 35 at a rotational speed sufficient to produce eddies in the liquid metal filling the crucible 26; at the same time, a valve 21 inserted in pipe line 20 is opened for feeding fluidized addition bed into the crucible 26, and valve 51 inserted in line 45, or alternatively valve 52 inserted in line 46, according as the subsequent casting is to take place in vacuo or in argon atmosphere is also opened. When the necessary amount of additions have been introduced into the crucible 26 through line 20 and these additions have been stirred sufficiently in the liquid metal filling the crucible, by virtue of the turbulence created on the one hand by the helical stirring member 35 and, on the other hand, by the electromagnetic field generated in the liquid metal by the inductor 28, the crank 32 is actuated to lift the stopper-rod 30 and open the runner or casting orifice 29, thus filling the mould 49 in vacuo or in an argon atmosphere, as already explained in the foregoing; when the casting or filling of mould 49 is completed, the runner 29 is closed again by actuating the crank 32 to the proper extent, and after cooling the cast ingot is stripped so that another ingot can be cast. Of course, the ingot-mould 49 illustrated may also be a detachable one so that another empty mould can be substituted therefor without waiting until the metal has cooled to a suitable "handling" temperature.

Many changes and modifications may be brought to the apparatus illustrated in FIG. 3 without departing from the basic principles of the present invention; some of these changes and modifications will readily occur to those conversant with the art. Thus, the helical stirring member 35 may be dispensed with, or replaced with or completed by a stirrer or agitator coupled directly to the rotor, immersed in the liquid metal filling the crucible 26, of an electric motor having its stator disposed externally of said crucible 26, so that the stator field can induce a positive torque in said rotor; an ultrasonic emitter 53 may be immersed in the liquid metal filling the crucible 26 to produce or at least promote the stirring effect in the additions mixed with the liquid metal. The frequency of the electric current energizing the heating coil 28 of crucible 26, the residual pressure maintained in chamber 24 by the pumping means connected to conduit 45, as well as the pressure and nature of the gas to be supplied to said chamber 24 via conduit 46, are matters of choice.

In FIG. 3, a further improvement is illustrated which is particularly advantageous for utilizing particulate additions in the form of grains having an average size of less than one micron, inasmuch as it is capable of preventing the agglomeration or packing of these very fine powders into balls or cakes, thus promoting their subsequent perfectly homogeneous dispersion through the mass of molten metal filling the crucible 26. This improvement consists essentially, in the embodiment illustrated in FIG. 3, in utilizing a filamentary electrode 54 projecting through an insulating plug 55 into a suitable section of the pipe line 20 directing the fluidized bed into the crucible 26; within said pipe line 20 the electrode 54 is so disposed as to be somewhat spaced and therefore not in electric contact with the walls of said line 20, so that its end lies at a predetermined height above the liquid contained in said crucible 26. The portion of the filamentary electrode 54 which is disposed externally of the pipe line 20 is connected on the other hand to one terminal of a high-voltage d.c. generator (having an output of 50,000 to 100,000 V), the other terminal of this generator (not shown) being electrically connected to the metal contained in said crucible 26, notably through the metallic elements of the apparatus and the ground (alternatively, the other terminal of said generator may be connected to an electrode immersed in the molten metal). Thus, a strong electric current voltage gradient is produced between the end of the filamentary electrode 54 located adjacent the flow of fluidized bed, on the one hand, and the free surface of the molten metal contained in said crucible 26, on the other hand, in order to electrify the particles in said fluidized bed; as all these particles receive charges of the same polarity, they are less prone to agglomerate into balls or cakes than neutral particles of the same granulometry (less than one micron), thus promoting their homogeneous dispersion throughout the molten metal.

Figure 4:
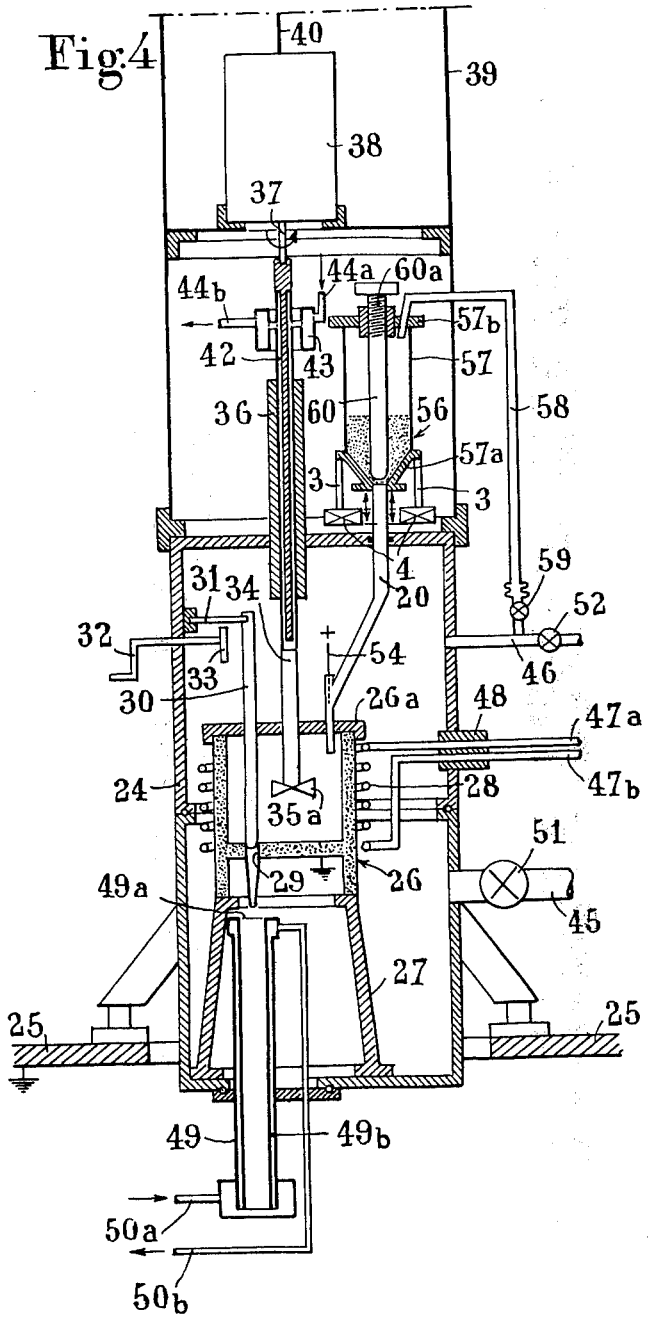

In FIG. 4 a modified embodiment of the structure illustrated in FIG. 3 is shown; the elements found in both embodiments of FIGS. 3 and 4 are designated by the same reference numerals. Whereas in the apparatus of FIG. 3 the fluidized bed is fed to the crucible 26 via a pipe line 20, from a separate fluidizing device, for example one of the type shown in FIGS. 1 and 2, in the embodiment illustrated in FIG. 4 this fluidizing device designated in general by the reference numeral 56 is mounted directly above the chamber 24 receiving the crucible 26. This device comprises essentially a container 57 having a funnel-shaped bottom 57*a* into which opens the upper end of a substantially vertical pipe line 20 of refractory material, which extends through the upper wall of chamber 24 and also through the detachable cover 26*a* of crucible 26, into which opens the lower end of said pipe line 20; argon is fed into the upper portion of container 56 via a branch line 58 of conduit 46 which is controlled by a valve 59; the cover 57*b* of container 57 receives therethrough a vertical rod 60 (the corresponding passage opening being sealed by a suitable packing), the lower end of said rod 60 constituting a plug or valve member co-acting with the tapered lower portion of the funnel-shaped bottom 57*a* of container 57; the position of this plug or valve member 60 in relation to the tapered bottom 57*a* may be adjusted by moving said rod 60 vertically, and to this end this rod may comprise a screw-threaded portion 60*a* at its upper end for engagement in a tapped bearing rigid with the cover 57*b*. The columns 3 supporting said container 57 are carried by vibrating tables 4.

In the arrangement illustrated in FIG. 4 the stirring device comprises essentially a screw or fan 35*a* having a shaft 34 extending freely but in a fluid-tight manner through the cover 26*a* of crucible 26, said shaft 34 being disposed vertically and eccentrically in relation to said crucible 26. This eccentric mounting of the shaft of said helical stirring member in relation to the crucible 26 (which is also visible in FIG. 3, where it is more enhanced than in FIG. 4) should be inasmuch enhanced as said crucible 26 has a more symmetric configuration, for example a circular cross-sectional shape, in order to avoid the creation, in the molten metal contained in said crucible 26, of streamlines following horizontal paths or lying in horizontal planes, since this would cause the addition particles to follow plane, parallel paths; in contrast thereto, the eccentric position of the helical stirring member produces in the molten metal streamlines following non-horizontal paths, thus ensuring the circulation of addition particles depthwise in the molten metal.

Now various examples of practical applications of a process for producing composite alloys by means of the apparatus illustrated in FIG. 4 and described hereinabove will be described.

EXAMPLE 1

Referring to FIG. 3, after removing the cover 26*a* of crucible 26 and the helical stirring member 34, 35*a* by actuating the pulley-block 41, aluminium ingots of the A5 grade (99.5% pure Al) are introduced into the crucible 26 while keeping the stirring member in its upper position so that its screw end lies in the upper portion of the crucible, above the level of the ingots introduced into it. By using means not shown in FIG. 4, aluminium powder of grade $\alpha$ and of well-defined grain or particle size (the granulometry of this powder being selected within the range of 0.1 to 10 $\mu$, and preferably less than 1 $\mu$) is introduced into container 57. Then valve 51 is opened to create a sufficient vacuum in chamber 24 and the coil 28 of crucible 26 is supplied with high-frequency electric current and cooling water for heating the crucible together with its contents, in vacuo, to a temperature of about 600° C, thus degasing the crucible and its load. Thereafter, valve 51 is closed and valve 52 is opened to fill the chamber 24 with argon, and the supply of coil 28 is adjusted to gradually heat the aluminium ingots contained in said crucible 26 firstly to their melting temperature and then to a suitable processing temperature selected to be preferably of the order of 1,250° to 1,300° C). When the aluminium has molten sufficiently the screw 35*a* of the stirring member is lowered into the molten metal by actuating the pulley-block 41, and this screw 35*a* is driven, by energizing its motor 38, at a speed of 500 to 900 r.p.m. When the molten metal has attained the selected temperature in the manner set forth hereinabove, the screw-rod 60 of device 56 is rotated in order to raise slightly its lower end above the tapered bottom 57*a* of container 57, and valve 59 is turned on so that pressurized argon will flow from top to bottom through the container 57 and eventually escape via pipe line 20 while carrying along the fluidized bed of alumina particles. If these particles are less than 1 micron in size, a 50,000 to 100,000-Volt direct current is fed to the filamentary electrode 54 in order to electrify them and thus prevent the accumulation of cakes or balls while promoting their homogeneous dispersion in the metal melt, in which they are stirred by the screw stirrer 35*a*. Suitable means well known to those conversant with the art and therefore not described herein are provided for measuring the throughput of alumina particles carried along by the argon stream through pipe line 20, and discontinuing the supply of such particles to the metal bath by actuating the valve rod 60 in the opposite or closing direction when the proportion (by weight) of the particles thus dispersed in the metal bath has reached a predetermined value selected to be preferably within the range of 3 to 10% by weight. Therefore, the time necessary for achieving the operation is variable, and of the order of 5 to 45 minutes. The actuation of the screw stirring member 35*a* is continued thereafter, until a perfectly homogeneous dispersion is obtained. Then the runner 29 is opened by actuating the crank 32 and thus an ingot consisting for example of a cylindrical bar approximately 500 mm long and having a diameter of 60 mm is cast in an argon atmosphere into the ingot mould 49.

The ingot is then stripped and cut into plates about 12-mm thick which are subsequently hot-rolled-(at about 400° C) to improve the homogeneous dispersion of the alumina powder in the aluminium matrix. This rolling operation comprises for instance a series of passes each producing a thickness reduction of about 0.6 mm, and annealing treatments at about 400° C are applied to the product between these passes; thus, the end product is a composite-structure sheet about 4-mm thick which is eventually annealed at about 350° C during 5 hours.

If a substantial departure from the above-defined processing steps and conditions is made, the following consequence will be observed: if the temperature of the metal bath receiving the fluidized bed is kept within lower limits of, say, 1,100° to 1,250° C, the liquid composite product thus obtained consists of a high-viscosity magma that cannot flow to form a casting; on the other hand, if the temperature of the metal bath exceeds 1,300° C, the particles accumulate into cakes by sintering, and between 1,350° and 1,400° C gaseous $Al_2O$ is released, in the form of bubbles carrying along the particles towards the free surface of the metal bath while developing blisters in the cooled ingot. Satisfactory products may still be obtained by utilizing alumina powders having a granulometry of less than 0.3 $\mu$, and even as low as 0.02 $\mu$, provided that the accumulation of agglomerated particles is prevented by the fluidized bed electrification, as described hereinabove.

The rolled product of which the manufacturing process has been described hereinabove is characterized by mechanical properties far better than those of the pure aluminium constituting its matrix; its elastic limit is higher (the difference is about 70%) and its tensile strength or breaking load about 5 to 15% better than that of A5-grade aluminium; at temperatures of the order of 200° to 300° C the elastic limit and breaking load of the rolled product according to this invention remain higher by about 40 to 80% and 15 to 50%, respectively, than those of said A5-grade aluminium. In an extrusion test carried out at a temperature of 200° C, a test bar made from a rolled product according to this invention displayed after 10 hours a breaking stress improved by 15 to 35% over that of A5-grade aluminium under the same testing conditions.

EXAMPLE 2

The manufacturing process described in Example 1 is repeated, except that cubic zirconium dioxide stabilized by the addition of 5% of lime and in the form of grains having a granulometry of 1 to 10 $\mu$ is substituted for alumina powder; the percentage by weight of the powder thus dispersed in the metal bath is limited to a well-defined value selected preferably in the range of 10 to 20% by weight. In this case, the total time for introducing this powder into the metal bath and stirring this bath is limited, preferably, to a value of 10 to 15 minutes. Then, the metal bath is kept at a temperature preferably within the range of 850° to 890° C. Above 900° C, upon solidification, the $ZrAl_3$ compound develops and blisters due to gaseous release appear in the ingot. The dispersion of the addition particles in the aluminium matrix can be further improved by means of a rolling operation. The rolled product thus obtained has an elastic limit and a breaking load exceeding by 40 to 75% and 15 to 35%, respectively, those of A5-grade aluminium; at 200° C its elastic limit and breaking load exceed by by 80 to 170% and 35 to 100% respectively those of A5-grade aluminium. A test bar made from a rolled product of this character and submitted to an extrusion test at 200° C has a breaking stress (after 100 hours) exceeding by 80% that of A5-grade aluminium under the same testing conditions.

EXAMPLE 3

The same manufacturing procedure is adhered to by utilizing a $TiB_2$ or TiN powder in particles of a few microns or preferably less than one micron; this powder is fed to the metal bath in a well-defined proportion ranging preferably from 10 to 20%; the metal bath is then held at a temperature approximating 900° C. Below this temperature, for instance at 700° C, the particles tend to accumulate into cakes and balls. The particle dispersion in the cast ingot is sufficiently homogeneous to permit of dispensing with a subsequent rolling operation. The product thus obtained has an elastic limit and a breaking load greater by 100% and 25%, respectively, than those of A5-grade aluminium. The modulus of elasticity of the end product has a value comparable to that of high-grade aluminium alloys. When tested by extrusion at 200° C, a test bar made of said product has a breaking stress (after 100 hours) greater by about 50% than that of A5-grade aluminium. This product is further characterized by a high ductility and therefore by a very low fragility.

What is claimed is:

1. A process for preparing a reinforced composite alloy without residual porosity, having improved properties and particularly good ductility, consisting of a matrix of very pure aluminium having dispersed therein 3 to 20% by weight of a refractory material addition in grain form, said addition being insoluble in aluminum both in the solid and liquid states, and said addition grains being dispersed homogeneously throughout the aluminum matrix to which they are bonded individually, said process comprising the following steps:

a. forming a dispersion of grains of a refractory material using a fluidized suspension in a stream of preheated gas, which is neutral with respect to the addition grains and to the aluminum;
b. desorbing moisture, oxygen and nitrogen from said grains to superficially activate said grains;
c. introducing said dispersion into molten aluminum with energetic stirring, at a temperature selected in the range from 850° to 1300° C to form a homogeneous composite alloy;
d. degasing the homogeneous composite alloy;
e. casting and solidifying the composite alloy;
f. subjecting the solidified composite alloy; to at least one hot-rolling step at about 400° C; and
g. subjecting the rolled composite alloy to at least one annealing step at about 350° C.

2. A process according to claim 1, wherein said addition consists of $TiB_2$ grains having substantially the same average size selected in the range from one fraction of a micron to a few microns, said molten aluminum being kept at a temperature substantially equal to 900° C.

3. A process according to claim 2, wherein said matrix consists of 99.5% pure aluminum, and said addition consists of 10 to 20% by weight of said $TiB_2$ grains.

4. The process according to claim 1, wherein said addition consists of TiN grains having substantially the same average size selected in the range from one fraction of a micron to a few microns, the molten aluminum being kept at a temperature substantially equal to 900° C.

5. A process according to claim 4, wherein said matrix consists of 99.5% pure aluminum and said addition consists of 10 to 20% by weight of said TiN grains.

* * * * *